US009046332B2

(12) United States Patent
Peterson et al.

(10) Patent No.: US 9,046,332 B2
(45) Date of Patent: Jun. 2, 2015

(54) PROJECTILE ASSEMBLY WITH STABILIZATION/OBTURATION ENHANCEMENT

(71) Applicant: Alliant Techsystems Inc., Minneapolis, MN (US)

(72) Inventors: Bryan P. Peterson, Isanti, MN (US); Erik K. Carlson, Oak Grove, MN (US); Adam J. Moser, Albany, MN (US); Lawrence P. Head, Cambridge, MN (US)

(73) Assignee: VISTA OUTDOOR OPERATIONS LLC, Clearfield, UT (US)

( * ) Notice: Subject to any disclaimer, the term of this patent is extended or adjusted under 35 U.S.C. 154(b) by 0 days.

(21) Appl. No.: 13/738,646

(22) Filed: Jan. 10, 2013

(65) Prior Publication Data

US 2014/0190364 A1 Jul. 10, 2014

(51) Int. Cl.

| | |
|---|---|
| ***F42B 14/06*** | (2006.01) |
| ***F42B 5/02*** | (2006.01) |
| ***F42B 7/08*** | (2006.01) |
| ***F42B 7/10*** | (2006.01) |

(52) U.S. Cl.

CPC ..... *F42B 14/064* (2013.01); *F42B 5/02* (2013.01); *F42B 7/08* (2013.01); *F42B 7/10* (2013.01)

(58) Field of Classification Search

USPC ..... 102/439, 449, 450, 451, 453, 461, 520, 102/521, 522, 524

See application file for complete search history.

(56) References Cited

U.S. PATENT DOCUMENTS

| | | | | | |
|---|---|---|---|---|---|
| RE1,788 | E | * | 10/1864 | Smith | 102/522 |
| 50,692 | A | * | 10/1865 | Dana | 102/520 |
| 384,574 | A | * | 6/1888 | Hawley | 102/520 |
| 3,802,345 | A | * | 4/1974 | La Costa | 42/78 |
| 3,905,299 | A | * | 9/1975 | Feldmann | 102/522 |
| 4,488,491 | A | | 12/1984 | Rhodes | |
| 4,574,703 | A | | 3/1986 | Halverson | |
| 4,669,385 | A | * | 6/1987 | Maki | 102/453 |
| H000941 | H | * | 8/1991 | Wyluda | 102/522 |
| 5,175,394 | A | * | 12/1992 | Sowash | 102/522 |
| 5,214,238 | A | | 5/1993 | Young | |
| 5,471,931 | A | * | 12/1995 | Gardner | 102/449 |
| 5,479,861 | A | * | 1/1996 | Kinchin | 102/439 |
| 5,621,187 | A | * | 4/1997 | Kearns | 102/520 |
| 6,073,560 | A | * | 6/2000 | Stone | 102/522 |
| 6,105,506 | A | * | 8/2000 | Gangale | 102/439 |
| 6,481,356 | B2 | * | 11/2002 | Gualandi | 102/439 |
| 6,502,516 | B1 | * | 1/2003 | Kinchin | 102/517 |
| 6,752,084 | B1 | * | 6/2004 | Husseini et al. | 102/466 |
| 7,302,891 | B1 | * | 12/2007 | Adams | 102/514 |
| 7,302,892 | B1 | | 12/2007 | Meyer et al. | |
| 7,549,376 | B1 | * | 6/2009 | Grossman et al. | 102/473 |

* cited by examiner

*Primary Examiner* — Bret Hayes
(74) *Attorney, Agent, or Firm* — Christensen Fonder P.A.

(57) ABSTRACT

A projectile assembly comprises a base portion for receiving projectiles such as slugs and has an associated pusher plate at a rear end thereof for minimizing or controlling deformation of the rear end of the base portion during firing. The pusher plate has a disc with one or more axially extending projections that extend axially into the rearward end of the base portion thereby reinforcing the base portion and upon firing providing uniform axial deformation and/or obturation of the base portion with respect to a firearm barrel. The projectile assembly may be, for example, part of a shotgun shell slug cartridge, and provides enhanced accuracy over the prior art.

20 Claims, 16 Drawing Sheets

PROJECTILE ASSEMBLY WITH STABILIZATION/OBTURATION ENHANCEMENT

FIELD OF THE INVENTION

The present invention is generally directed towards projectiles, such as slugs with polymer projectile seating bases, for example a sabot with a projectile seating base, and means for enhancing the performance thereof.

BACKGROUND OF THE INVENTION

Slugs or bullets fired from shotguns fitted with rifled barrels or from muzzleloaders are often fitted with a sabot that releases the slug or bullet as the projectile exits the muzzle of the firearm. Sabots significantly improve the range and accuracy of the projectile by engaging the rifling of the barrel to impart spin to the projectile and also seal the barrel around the projectile to prevent leakage of the generated propellant gasses around the projectile. Sabots for small arms, such as shotgun slugs or for muzzleloaders, typically comprise a plurality of wings extending from a base portion configured as a projectile seating base on which the projectile is seated. Prior to firing, the wings are folded forwardly to form a recess configured as a cup for receiving the projectile. As the saboted projectile travels down the barrel during firing, the wings and/or projectile seating base engage the rifling of the barrel to impart spin to the projectile. Once the saboted projectile exits the muzzle, the wings flare open, flexing where they attach to the projectile seating base, to slow the sabot and release the projectile to travel on to the target.

Sabots used for conventional firearms are often injected molded as a single body in a simple manufacturing process that maintains a low cost per unit of ammunition. Polymers, such as high density polyethylene, provide favorable characteristics such as engagement of barrel rifling, absorption of shock peaks from the propellant, and gas sealing. However, an inherent drawback of polymer sabots is that the polymer can unevenly axially deform, disintegrate or destruct when subjected to the high pressure forces used to fire the projectile. In particular, the projectile seating base, which is intermediate or sandwiched between the projectile and the propellant charge, experiences the significant compression during firing often resulting in substantial deformation. Uneven axial deformation of the projectile seating base and other parts of the sabot can impart generate a wobble, yaw, precession, and/or nutation of the projectile particularly after the projectile leaves the barrel resulting in diminished accuracy. Such uneven deformation and disintegration is also believed to effect the uniform deployment of the wings after the sabot exits the muzzle. In addition, higher ambient temperatures have been observed to increase disintegration of sabots having discs further diminishing the accuracy of the projectile.

Efforts have been made to reinforce polymer sabots and improve performance and accuracy. Metal discs are disclosed in U.S. Pat. Nos. 4,574,703, 5,214,238 and 7,302,892, positioned rearwardly of or embedded within the projectile seating base of the sabot to reinforce the projectile seating base and provide an "area multiplier". Typically such metal discs are made of steel. The added weight of the larger metal discs for reinforcing sabots, particularly steel discs, increases the overall weight of the saboted projectile, requiring more propulsion for providing the same muzzle velocity for the projectile. Moreover, the manufacture of sabots with discs such as shown in the '892 patent require more difficult and complicated molding techniques, for example, insertion of the metal disc in a mold cavity before injection of the polymer resin.

The deformation of sabots may be exaggerated with saboted projectiles used in muzzle loaded firearms where the saboted projectile is loaded flush against the propellant charge. Unlike shotgun cartridges where compressible plastic wadding is positioned against the rear of the saboted projectile, the saboted projectile is positioned directly against the propellant charge and can allow for even greater deformation of the projectile seating base.

In addition to projectile seating bases in sabots of shotgun slugs, other projectile seating bases can be improved to provide more controlled uniform axial compression and thereby more uniform force to the projectiles and better accuracy.

There is a need for cartridge configurations where disintegration of the sabot is minimized with minimal additional weight and minimal additional cost. There is a need for shotgun shells with saboted projectiles with enhanced performance including consistently improved accuracy even under elevated and varying operating temperatures.

SUMMARY OF THE INVENTION

A sabot, in an embodiment of the present invention, includes a base and a rigid backside pusher plate abutting, confronting, or facing the projectile seating base of the sabot. The pusher plate further comprises at least one forwardly extending axial projection extending partially or fully through the projectile seating base of the sabot. The inventors found that non-uniform axial deformation and/or disintegration of the projectile seating base during firing causes the projectile to rotate out of alignment with longitudinal axis defined by the barrel of the firearm. The misalignment of the projectile combined with the spin imparted by the rifling of the barrel results in a "wobbling" projectile in which the projectile is cycling or rotating around the ballistic path of the projectile with the longitudinal axis defined by the projectile being transverse to the ballistic path.

The projection of the pusher plate can be positioned in alignment with the central longitudinal axis of the projectile and barrel to guide the axial deformation of the seating base portion such that the longitudinal axis of the projectile remains in alignment with the longitudinal axis of the barrel. During the firing of the propellant, the projectile seating base of the sabot, directly behind the slug, is highly compressed. With the projection of the pusher plate extending axially in the base portion, any yaw of the pusher plate is effectively prevented by the stabilizing effect of the projection rigidly attached to the disk, the projection extending into and axially fixed within the projectile seating base portion of the sabot. Even upon firing, this axial fixation of the projection is maintained or enhanced as the base portion is highly compressed. This "axial fixation" in turn prevents or minimizes any non-uniform forward motion of the plate (that is a "yaw") in that the disk portion is rigidly attached to the projection. This then prevents or minimizes any non-uniform deformation of the projectile seating base. Generally, it is believed that the farther forward the projection extends in the base portion, presuming the disk and projection are rigid and rigidly attached, the greater the yaw prevention of the pusher plate lessening the non uniform axial deformation of the base portion and increasing the stability of the projectile.

Thus, a feature and advantage of embodiments of the invention is that the highly compressed state of the projectile seating base from the propellant forces, acting through the pusher plate, and the setback forces of the slug, is utilized to prevent non uniform deformation of the projectile seating base of the sabot. The original position of the projection is in axial alignment and the disc portion is fixed to the projection and thus the axial alignment of the projection and the perpendicular positioning of the pusher plate is maintained as the sabot travels down the barrel, precluding uneven or non-uniform compression of the projectile seating base of the sabot and precluding or minimizing wobble of the projectile.

A feature and advantage of embodiments of the invention is that obturation of the projectile seating base is enhanced by the uniform axial compression and radial deformation of the projectile seating base, thereby providing better engagement with rifling and better sealing with the interior of the barrel.

A feature and advantage of particular embodiments of the invention is that the projection or projections extending from the plate can reduce compressive axial forces on the projectile seating base by transferring a portion of the propellant forces past a portion of the axial length of the projectile seating base, to the slug or to portions of the projectile seating base adjacent the slug. During firing, the projectile seating base portion of the sabot is sandwiched between the propellant force of the gases generated from the ignited propellant and the opposing setback forces of the projectile created by the inertia of the projectile. These opposing forces weaken and unevenly "pancake" the base of conventional sabot weakening the sabot or misaligning the projectile within the sabot. The reduction of the compressive forces at the rearward portion of the projectile seating base provided by the axially extending projection is believed to contribute in the substantial elimination the uneven deformation of the projectile seating base during firing that otherwise imparts wobble to the slug. Specifically, the even or lack of deformation provided by the axially extending projection of the pusher plate maintains the alignment of the longitudinal axis of the bullet with the axis of the barrel reducing wobble in the bullet after the bullet leaves the barrel.

High temperatures were also found to soften the polymer material of the sabot, thereby increasing the deformation or disintegration of the sabot. In one aspect, the projection reinforces the projectile seating base portion to reduce deformation or disintegration of the sabot despite the softening of the projectile seating base from the high temperatures. A feature and advantage of embodiments of the pusher plate is that said plate is more rigid and more heat resistant than the projectile seating base portion. The pusher plate positioned at the rear surface of the projectile seating base does not deform upon firing to the extent that the projectile seating base would deform upon firing.

A shotgun shell, according to an embodiment of the present invention, comprises a shotgun shell with a tubular casing, propellant, wadding, a slug and a sabot, the sabot having a base and a pusher plate abutting, confronting or facing toward the projectile seating base of the sabot. The propellant positioned at one end of the casing beneath the wadding with the saboted slug being positioned forward of the wadding. The pusher plate may be attached to the rearward end of the sabot by the post extending down a central axis of the projectile seating base into the projectile seating base. The pusher plate can be positioned on the exterior end of the projectile seating base in between wadding and the sabot and further comprise at least one forwardly extending axial projection extending at least partly through the projectile seating base of the sabot. In an embodiment of the invention, the pusher plate can be a disc portion configured as a thin flat disc shape, wherein the projection is configured as a post or prong extending into the projectile seating base.

In one aspect, the rear end of the projectile can define a conical or converging recess for receiving a corresponding forward projection of a pusher plate. Upon ignition of the propellant, forward pressure of the ignited propellant acts on the disc and the projection in the converging recess provides a centering effect on the disc and moreover encourages uniform axial deformation of the projectile seating base portion.

An embodiment of the invention is a method of manufacturing a shotgun shell with a slug. The method comprises injection molding a sabot having a base at a rearward end, foldable petals extending forwardly from the base, and a central recess at the rearward end of the base. Further the method comprises inserting a pusher plate with a central axial post into the central recess. The method further comprises installing a slug in the sabot, installing propellant, wading, and the sabot with the slug into a shotgun shell casing. A feature and advantage of the invention is that assembly steps and complexity of the manufacture is reduced and the shotgun shell performance is increased compared to other prior art configurations of shotgun shells with metal plates embedded in the sabot.

In one aspect, conventional shotgun shell components, including conventional sabots and conventional projectiles, can be assembled in accord with the invention by insertion of the projection of the pusher plate into the rear surface of the projectile seating base and then otherwise conventionally assembled. In one aspect, the conventional wadding may be slightly shortened axially to accommodate the thickness of the pusher plate. A feature and advantage of embodiments of the invention is that this inexpensive additional component provides increased accuracy and reduces obliterated sabots.

A polymer sabot, according to an embodiment of the present invention, comprises a pusher plate with a forward extending axial projection that controls the application of force to the projectile seating base to minimize or control the deformation of the projectile seating base and can practically eliminate excess deformation or failure of the sabot. The pusher plate is positioned against the rear of the projectile seating base and comprises at least one projection extending axially into the projectile seating base. The projection can be sized such that the end of the projection is proximate the rear of the projectile once the projectile is seated on the polymer base. The projection comprises a rigid material to reduce axial compression of the polymer base as a result the opposing setback and propellant forces. The projection can also comprise a heat insensitive material to maintain the shape of the projectile seating base when the projectile seating base is exposed to high temperatures. In one aspect, several projections can be spaced around the central longitudinal axis of the sabot to prevent misalignment of the projectile as the projectile seating base is compressed.

A sabot assembly, according to an embodiment of the present invention, comprises a sabot and a pusher plate. The sabot comprises a projectile seating base and at least two wings or petals extending from the base portion. The projectile seating base defines a seat that cooperates with the wings or petals to form a cup for receiving a projectile. The pusher plate is positioned against the rear of the projectile seating base and further comprises at least one projection extending axially into the base portion. In one aspect, the diameter of the pusher plate can approximate the diameter of the polymer projectile seating base such that the majority or all of force generated by the ignited propellant is transferred to the pusher plate rather than polymer base portion. A feature and advantage of particular embodiments with forward axially extending projections, recesses for receiving the axially extending projections can be preformed in the projectile seating base to facilitate manufacture and assembly of a sabot/pusher plate assembly.

In an embodiment of the invention, a wobble stabilizing assembly comprising a cylindrical polymer portion with a central axis, a forward end and a rearward end, a disc with a central axially extending prong or post is positioned at the rearward end of the cylindrical polymer portion with the prong or post extending into the cylindrical polymer portion. The disc extends perpendicularly to the axially extending prong or post and is fixed thereto. The cylindrical polymer portion is positioned behind, directly engaged with or spaced from, a projectile to be fired. The propellant positioned rearwardly of the wobble stabilizing assembly, either in direct contact or spaced therefrom. Upon firing the axial compression of the cylindrical polymer portion is controlled to be uniform by way of the disc and central axial post fixed thereto. In embodiments of the invention the cylindrical polymer portion may have a central recess on the rearward side to receive the projection during an assembly step. The recess may also be tapered such that the outward radial expansion of the cylindrical polymer In an embodiment of the invention, an obturation enhancement assembly comprising a cylindrical polymer base with a central axis, a forward end and a rearward end, a disc with a central axially extending projection is positioned at the rearward end of the cylindrical polymer base with the projection extending into the cylindrical polymer base. The periphery of the disc is in a plane perpendicular to the axially extending projection and is fixed thereto, such as being unitary or a press fit. The cylindrical polymer portion is positioned behind, directly engaged with or spaced from, a projectile to be fired in a barrel. The propellant positioned rearwardly of the wobble stabilizing assembly, either in direct contact or spaced therefrom. Upon firing the axial compression of the cylindrical polymer portion is controlled to be uniform to provide uniform radial expansion of the cylindrical polymer portion around the entire circumference of the cylindrical polymer portion by way of the disc and central axial post fixed thereto.

In an embodiment of the invention, a wobble stabilizing and/or obturation enhancement assembly comprising a cylindrical polymer base with a forward end and a rearward end, the forward end to be facing a projectile, and a disc with a central axially and forwardly extending projection, the disc is positioned at the rearward end of the cylindrical polymer base with the projection extending into the cylindrical polymer portion. The cylindrical polymer base may be a portion of a unitary sabot or it may be a discrete component. As a discrete component it may be used in shotgun slug applications behind a sabot. It may effectively replace or minimize a separate wadding component. It may be formed of polyethylene, high density polyethylene, other polymers and may be solid therethrough, such as formed in conventional injection molding, or may have some porosity or spacing therein to increase axial compression.

In embodiments where the cylindrical polymer base is a discrete component, with the pusher plate at the rearward side, and where the polymer base is in direct engagement with the projectile, cooperating engagement feature may be provided to the forward end of the cylindrical base and the rearward end of the projectile such that as the cylindrical base obturates upon firing, and rotates due to the rifling, the projectile also will rotate. The cooperating engagement features may be a star shaped projection and a star shaped recess, a diametric rib on the cylindrical base portion and a matching diametric recess on the rearward end of the projectile. Such an embodiment is highly suitable for muzzle loading applications.

In one embodiment, the projection can comprise a single post extending along the central axis of the cylindrical polymer base. In another aspect, the projection can comprise a plurality of posts extending axially into the projectile seating base along an axis parallel to the central axis of the sabot. In this configuration, the posts are spaced evenly around the central axis to facilitate even force distribution through the polymer base. In yet another aspect, the projection can comprise a ring shape in which the ring is centered on the central axis of the sabot. The projections can comprise combination of rings and posts or can be tapered posts or spear shaped members. In another embodiment, the projection can be a central axial taper on forward side of the disk. The rearward side of the disk may have a complementary shape such that the disc is readily formed by conventional stamping. In an embodiment the central projection may be a separate prong with a head inserted through a disc and secured in place.

In one aspect, the projection can extend through the projectile seating base and engages the rear of the projectile either before firing or after firing during axial compression of the projectile seating base. The back side of the pusher plate is seated against the wad, which in turn is seated against the propellant. Upon ignition of the propellant, the generated gases push the wad against the pusher plate, which transfers the force through the projection to the rear of the projectile to act against the setback force created by the inertia of the projectile. As the inertia of the projectile is the primary resistive force preventing forward movement of the saboted projectile, the transfer of the propellant force to the projectile by the central projection causes the saboted projectile to move forward with reduced compression of the projectile seating base portion. Alternatively, the projection controls the deformation of the projectile seating base by the compressive force such that the projectile remains evenly seated on the projectile seating base despite the deformation, that is no yaw or pitch is introduced to the pusher plate.

A method, according to an embodiment of the present invention, of minimizing deformation of a sabot due to competing setback forces created by the inertia of a projectile seated within the sabot and propellant forces for propelling the saboted projectile, comprises positioning a pusher plate against the rear of the projectile seating base portion, wherein the pusher plate comprises a projection extending axially. The method further comprises directing the propellant force against the pusher plate such that a portion of the force is directed by the projection through the projectile seating base and into the rear of the projectile rather than the through the polymer base portion. Note in embodiments a projection(s) may extend rearwardly into the wadding and still provide a stabilizing effect, that is prevent or minimize non uniform axial displacement, that is yaw, of the disc portion thus controlling uniform deformation of the rear end of the sabot.

In an embodiment of the invention, a projectile assembly comprises an axially compressible and deformable cylindrical portion, positioned intermediate a projectile and a propellant, and has at an end face (rearward) towards the propellant, a disc and a central axial projection fixed to the disc and extending into the cylindrical portion. In embodiments, the axially compressible and deformable cylindrical portion is a polymer. In any of the above embodiments, the axially compressible and deformable cylindrical portion is a seating base for direct engagement with the projectile. In any of the above embodiments, cooperating features on a rear side of the projectile and the forward side of the cylindrical portion facilitate the joint rotation of the cylindrical portion and the projectile. In any of the above embodiments, the cylindrical portion is the base portion of a sabot wherein wings extend forward from the cylindrical portion. In the preceding embodiment, the sabot and projectile are part of a shotgun slug cartridge. In above embodiments the cylindrical portion is wadding in a shotgun shell cartridge. In above embodiments, the cylindrical portion is configured to fit muzzle loading guns and to engage a muzzle loading projectile. In any of the above embodiments, the disc is circular and the projection is rod shaped. In the above embodiments, the disc is circular and the projection has a taper. In any of the above embodiments the rearward facing surface of the cylindrical portion has an axial recess. In the preceding embodiment the axial recess is a bore extending into or through the cylindrical portion. In above embodiments, the axial recess has a taper going forward. In any of the above embodiments, the cylindrical portion is sized to obturate the barrel of the firearm in which it is used.

In an embodiment, a projectile assembly for conveying a projectile through a firearm barrel, the projectile assembly comprises: a projectile; a cylindrical polymer base positioned rearwardly of the projectile, the cylindrical polymer base having a forward end facing the projectile, a rearward end, and a length; a pusher plate in engagement with the rearward end of the cylindrical polymer base, the pusher plate having a disc portion with a periphery and a forwardly extending projection with a tip end extending from the disc portion and spaced from the periphery of the disc portion, and the forwardly extending projection extending into the cylindrical polymer base. In an embodiment, the cylindrical polymer base is unitary with a plurality of forwardly extending wings defining a sabot, the cylindrical polymer base and wings defining a projectile cup with the projectile seated therein. The sabot may be utilized in a shotgun shell cartridges with a slug.

A muzzleloader projectile, according to an embodiment of the present invention, comprises a projectile body, a polymer projectile seating base and a pusher plate having at least one axially extending projection. The projectile body comprises a generally conical shape and defines a longitudinal axis. The projectile body also defines an elongated inset cavity transverse to the longitudinal axis and positioned at the rear of the projectile body. The polymer base similarly comprises an elongated projection corresponding to the inset cavity of the projectile body. The muzzleloader projectile is assembled by positioning the polymer base against the rear of the projectile body such that the elongated projection interlocks with the elongated inset cavity. The projection can then be inserted into the polymer base such that the polymer base is sandwiched between the pusher plate and the projectile body.

In one aspect, the radius of muzzleloader projectile is nominally less than the inner diameter of the barrel prior to firing such that the muzzleloader can drop down the barrel without engaging or minimally engaging the rifling of the projectile. The reduced diameter of the projectile allows it to be rammed down the barrel with minimal resistance during loading. During firing the pusher plate causes the polymer base to expand radially to engage the rifling of the barrel. The expanded base obturates the barrel to prevent leakage of propellant gases around the projectile body as the projectile travels through the barrel to efficiently fire of the projectile. The pusher plate creates and controls the radial expansion of the polymer base such that the polymer base expands evenly, radially outward to seal the projectile to the barrel. Similarly, the engagement of the polymer base to the rifling imparts spin to the projectile body through the interlocking cavity of the projectile body and ridge of the polymer base.

A method, according to an embodiment of the present invention, for loading a muzzleloader comprises providing a projectile body, a polymer base and a pusher plate having at least one axially extending projection. The projectile body defines a longitudinal axis and an elongated inset cavity transverse to the longitudinal axis at the rear of the projectile body. The polymer base further comprises an elongated ridge shaped to correspond to the elongated inset cavity. The method further comprises positioning the polymer base against the rear of the projectile body such that the elongated ridge interlocks with the inset cavity of the projectile body, thus imparting torque to the projectile. The method also comprises inserting the projection into the rear of the polymer base to sandwich the polymer base between the pusher plate and the projectile body. The method further comprises dropping a propellant charge down a barrel. Finally, the method comprises dropping the assembled projectile down the barrel such that the pusher plate is proximate to the propellant charge.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify embodiments.

BRIEF DESCRIPTION OF THE DRAWINGS

The invention can be completely understood in consideration of the following detailed description of various embodiments of the invention in connection with the accompanying drawings, in which.

Figure 1:
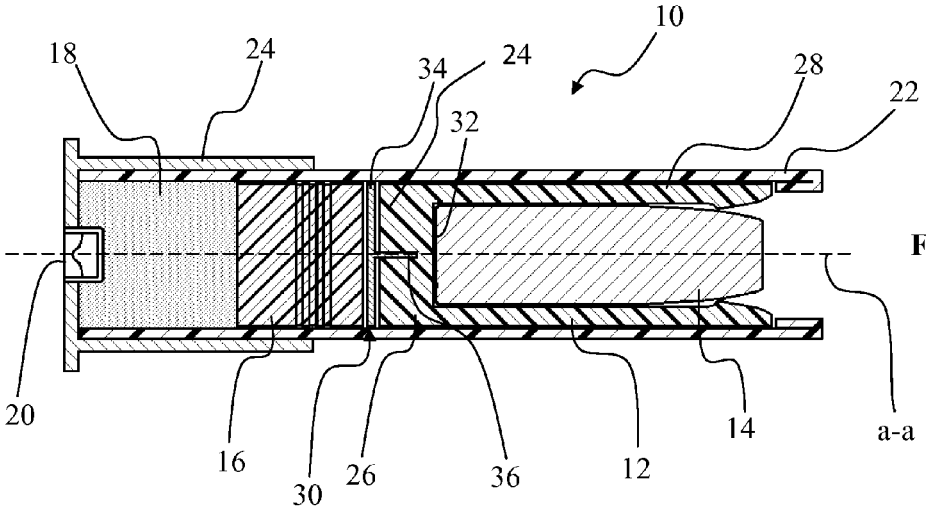
FIG. 1 is a partial cross-sectional side view of a cartridge having a pusher plate with a single post according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

As shown in FIGS. 1, 3, 5 and 7, a cartridge 10, according to an embodiment of the present invention, comprises a sabot 12, a projectile 14, wadding 16, a propellant charge 18 and a primer 20. The sabot 12 generally defines a cup for receiving the projectile 14. As depicted, the projectile 14 comprises a shotgun slug, but can comprise a bullet or any other conventional projectile deployable from the sabot 12. The wadding 16 is positioned forward of the propellant charge 18 to transfer the propellant force created by the expanding gases from the propellant charge 18. The primer 20 is positioned to be struck by the firing pin of the firearm to ignite the propellant charge 18. As depicted, the cartridge 10 is a shotgun shell and further comprises a casing 22 and a brass head 24. The casing 22 defines an enclosable cylinder for receiving the sabot 12, projectile 14, wadding 16 and the propellant charge 18. The brass head 24 reinforces the end of the casing 22 containing the propellant charge 18 to prevent blowout of the casing 22.

Figure 26:
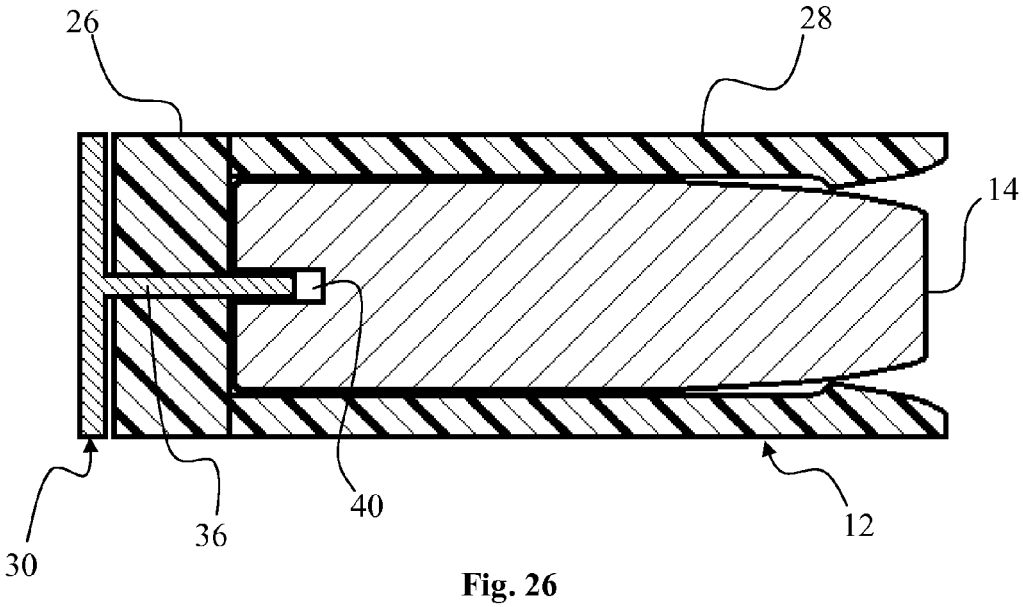
FIG. 26 is a cross-sectional side view of a cartridge having a pusher plate with a protrusion extending through a polymer base portion of a sabot and engaging the projectile according to an embodiment of the present invention.
Figure 27:
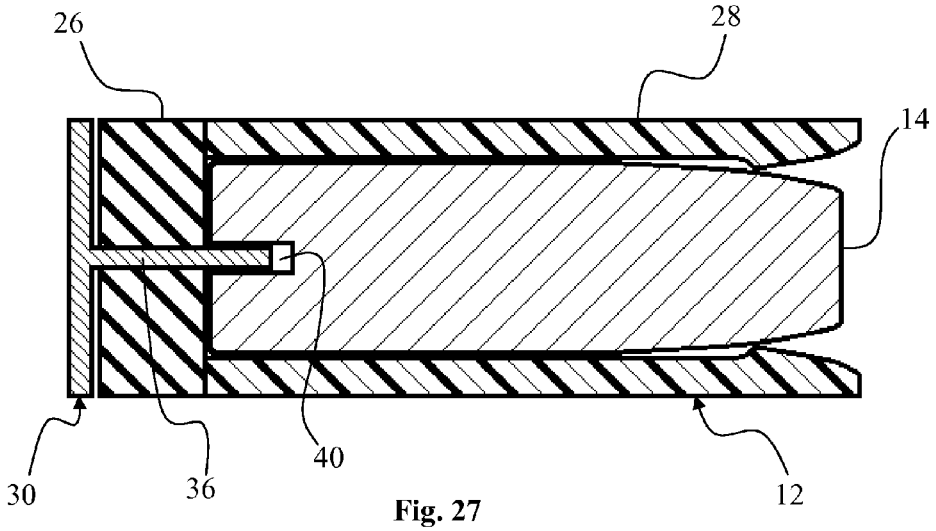
FIG. 27 is a cross-sectional side view of a cartridge having a pusher plate with a protrusion extending through an elastomeric base portion of a sabot and engaging the projectile according to an embodiment of the present invention.

As shown in the figures, the sabot 12 has a rear end 23, a cylindrical outer surface 25, a projectile seating base 26, at least two wings 28 and a pusher plate 30. The projectile seating base 26 defines a seat 32 on which the projectile 14 can be seated. The foldable wings 28 extend from the projectile seating base 26 and can be positioned to cooperate with the seat 32 to define a cup for receiving the projectile 14. When folded to form a cup shape, the sabot 12 defines a longitudinal axis a-a, that is, parallel with the central longitudinal axis of the projectile. In one aspect, the sabot 12 can be molded as a single body from a polymer including, but not limited to, polyethylene, particularly high density polyethylene. As depicted in FIGS. 26-27, in one aspect, the wings 28 are separately formed and affixed to the base portion 26. In this configuration, the wings 28 can be adapted to separate from the base portion 26 as the sabot 12 exits the barrel of the firearm.

Figure 16:
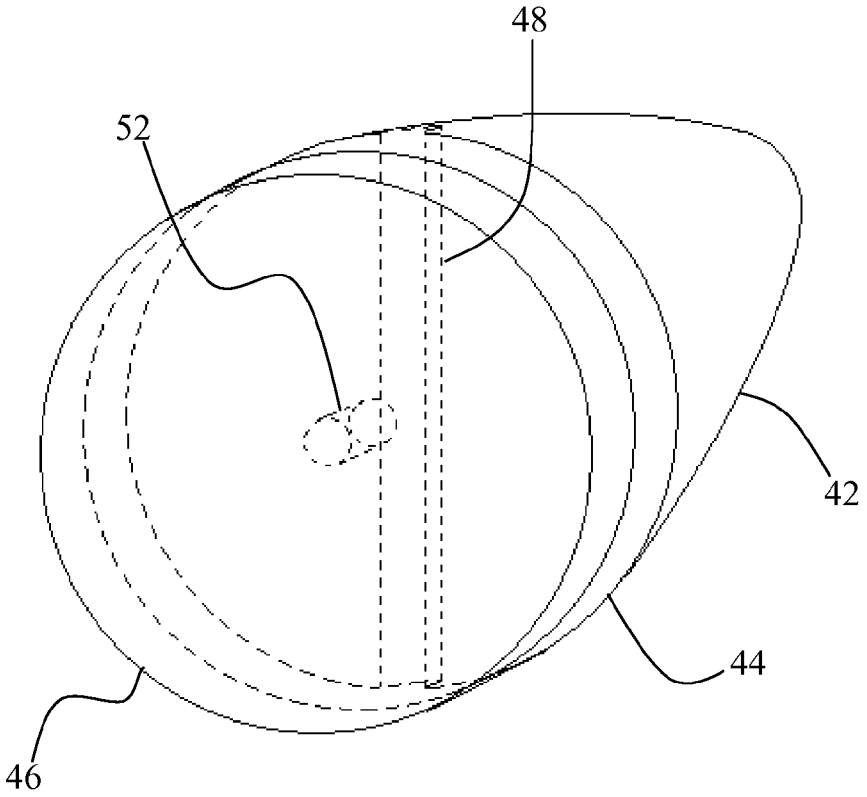
FIG. 16 is a partial cross-sectional perspective view of a muzzleloader projectile according to an embodiment of the present invention.
Figure 17:
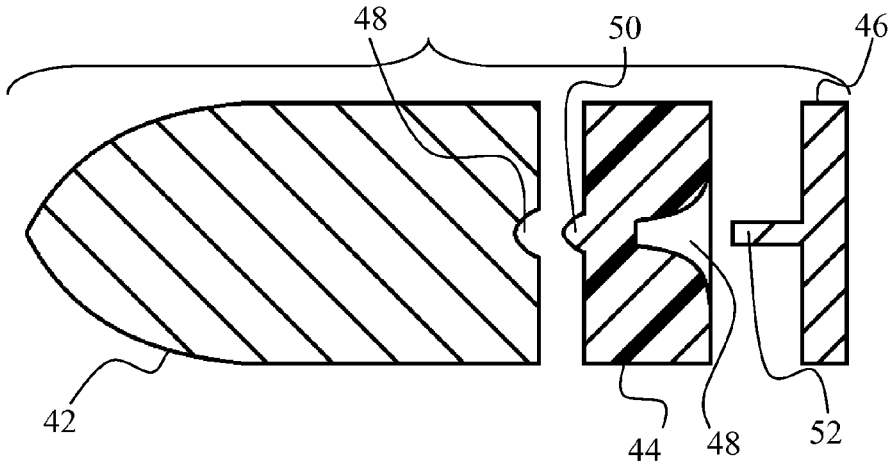
FIG. 17 is a cross-sectional exploded view of a muzzleloader bullet, according to an embodiment of the present invention.
Figure 24:
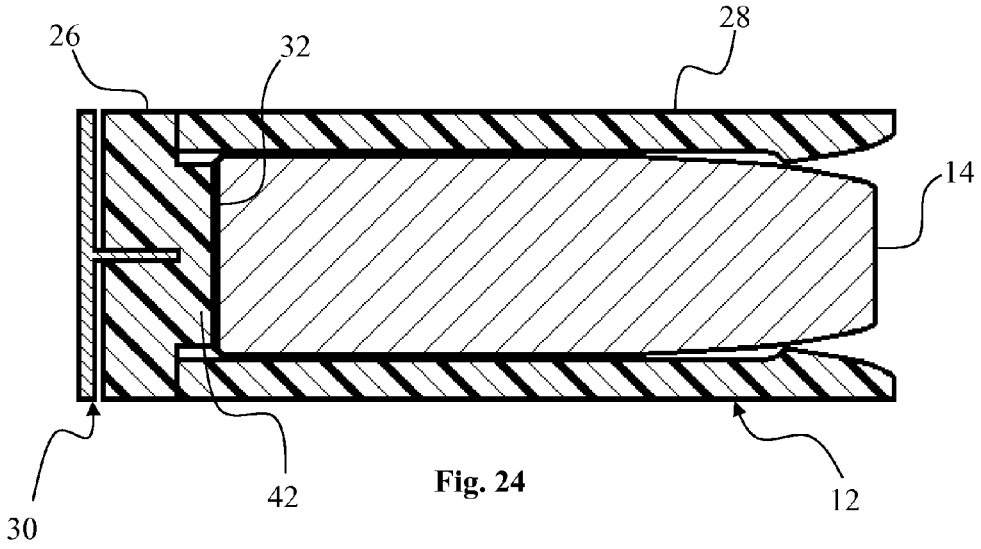
FIG. 24 is a cross-sectional side view of a cartridge having a sabot with a t-shape base portion and a pusher plate according to an embodiment of the present invention.
Figure 25:
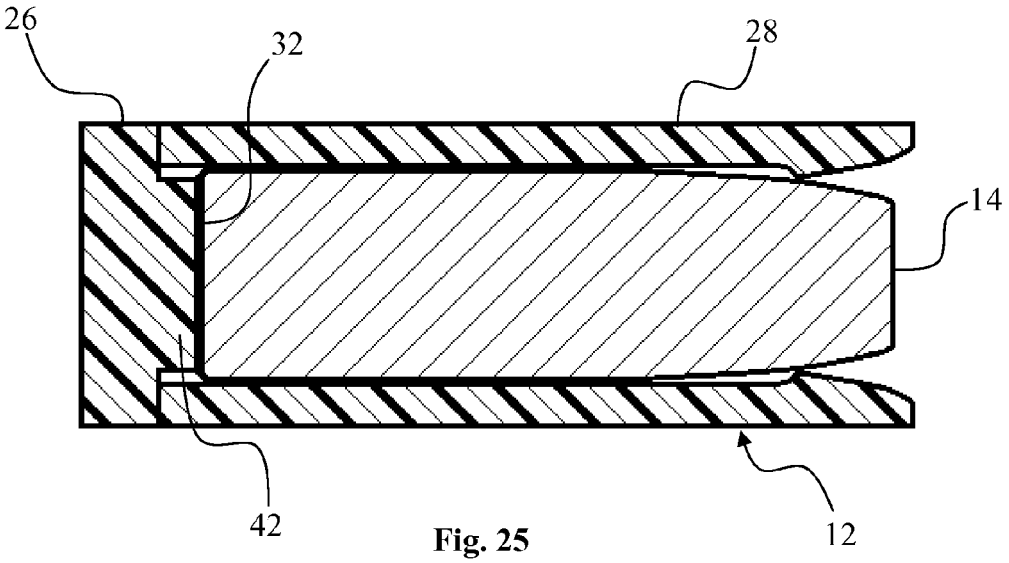
FIG. 25 is a cross-sectional side view of a cartridge having a sabot with a t-shape base portion and without a pusher plate according to an embodiment of the present invention.

As depicted in FIGS. 24-25, the seat 32 can comprise a pedestal 56 such that the base portion 26 defines a t-shaped cross section. The pedestal 56 provides area in which the base portion 26 can expand without significantly affecting the axial alignment of the projectile 14. In one aspect, as depicted in FIG. 16, the t-shaped base portion 26 can be provided without a pusher plate 30. In this configuration, the base portion 26 can comprise a rigid polymer minimizing deformation of the base portion 26 during firing.

Figure 2:
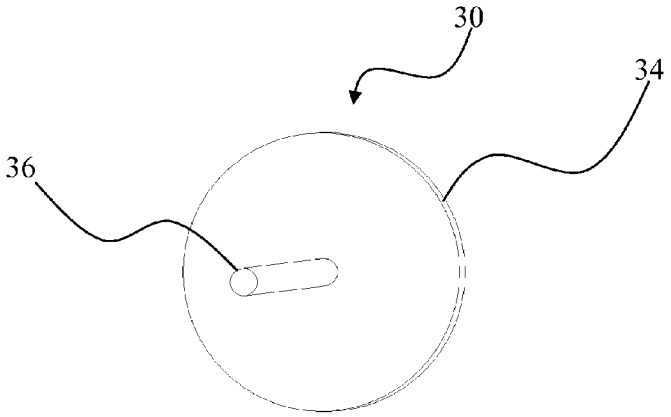
FIG. 2 is a perspective view of the pusher plate depicted in FIG. 1.
Figure 3:
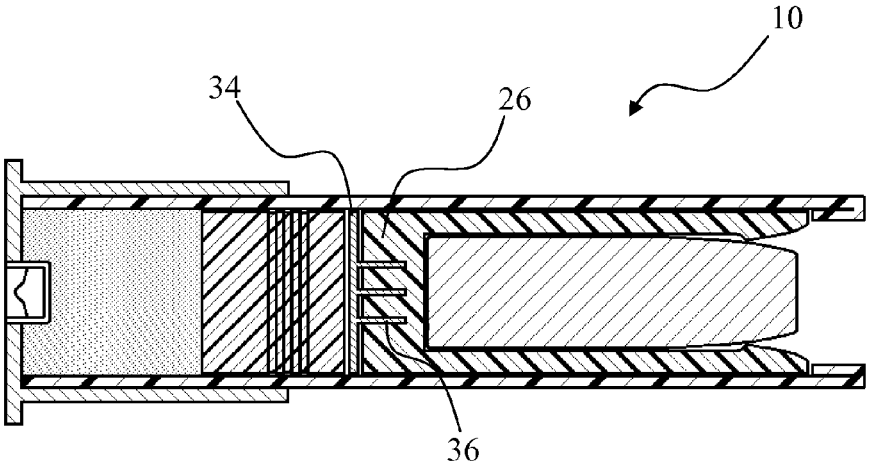
FIG. 3 is a partial cross-sectional side view of a cartridge having a pusher plate with a plurality of posts according to an embodiment of the present invention.
Figure 4:
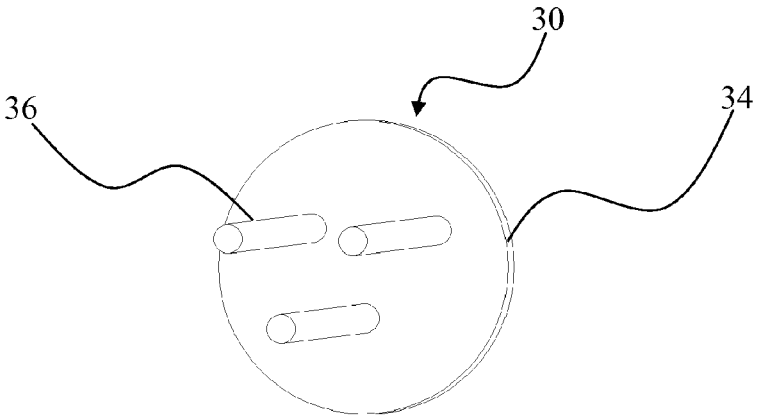
FIG. 4 is a perspective view of a pusher plate having three projections radially spaced from the central longitudinal axis of the pusher plate.
Figure 5:
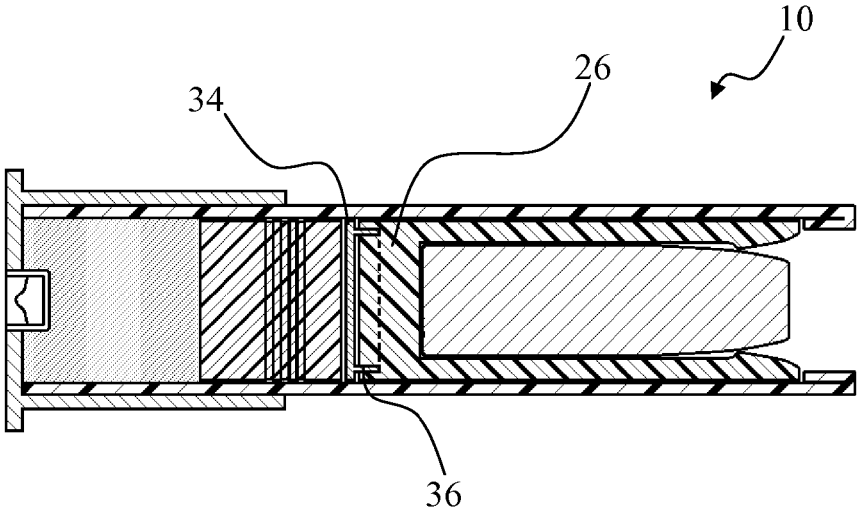
FIG. 5 is a partial cross-sectional side view of a cartridge having a pusher plate with a single ring according to an embodiment of the present invention.
Figure 6:
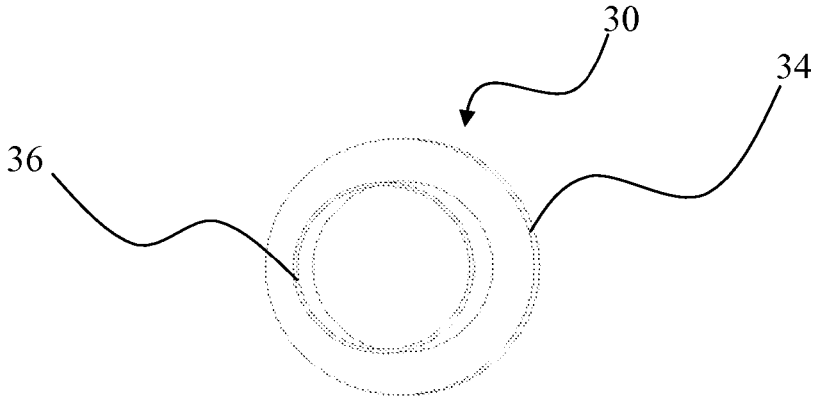
FIG. 6 is a perspective view of the pusher plate depicted in FIG. 5.
Figure 7:
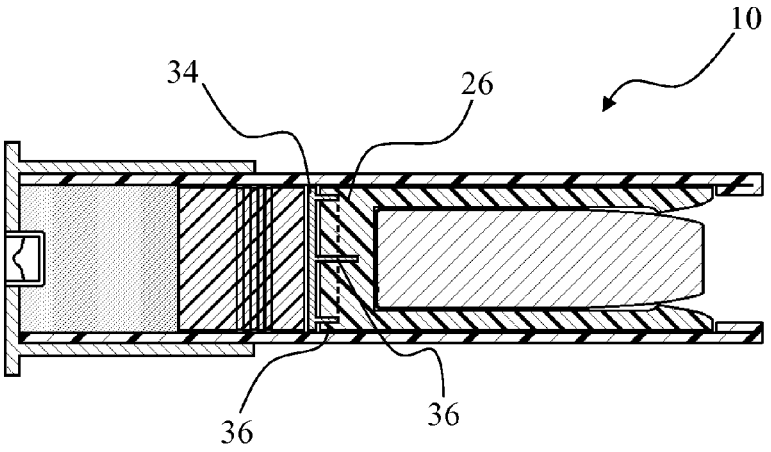
FIG. 7 is a partial cross-sectional side view of a cartridge having a pusher plate with a ring and a single post according to an embodiment of the present invention.
Figure 8:
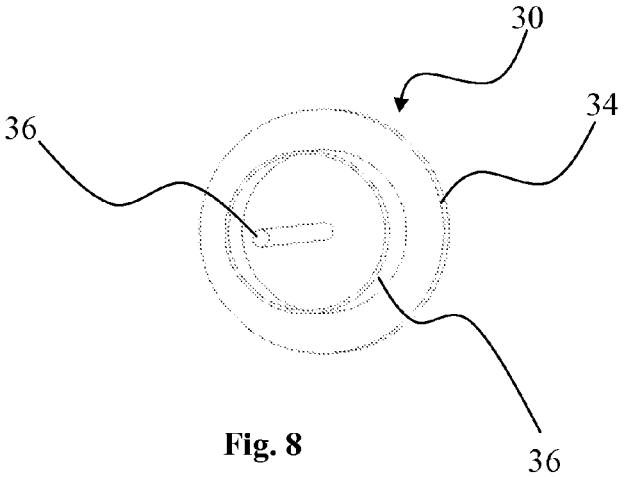
FIG. 8 is a perspective view of the pusher plate depicted in FIG. 7.
Figure 9:
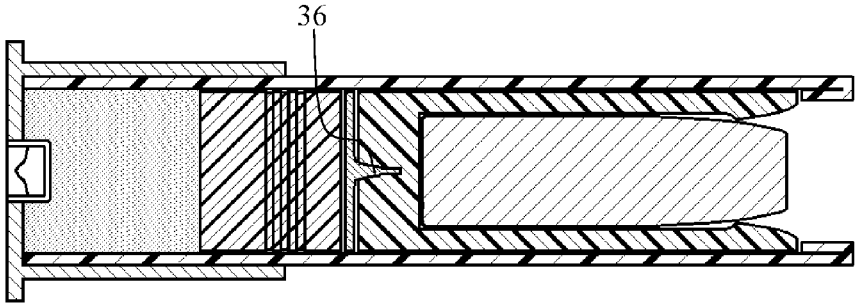
FIG. 9 is a partial cross-sectional side view of a cartridge having a pusher plate with a conical post according to an embodiment of the present invention.

As shown in FIGS. 1-8, the pusher plate 30 comprises a disc portion 34 and at least one projection 36 insertable into the projectile seating base 26 of the sabot 12. As shown in FIGS. 1-2, in one aspect, the at least one projection 36 can comprise a single post extending axially into the projectile seating base 26 along the central longitudinal axis a-a. As shown in FIGS. 3-4, in another aspect, the at least one projection 36 can comprise a plurality of posts extending axially into the base 26 along axis parallel to the central longitudinal axis a-a. As shown in FIGS. 5-6, in yet another aspect, the at least one projection 36 can comprise a least one ring centered on the central longitudinal axis a-a. Additionally, as shown in FIGS. 7-8, the at least one projection 36 can comprise a combination of rings centered on the central longitudinal axis a-a and posts extending along or in parallel to the central longitudinal axis a-a. Finally, as shown in FIG. 9, the at least one projection 36 can comprise a generally conical shape centered on the central longitudinal axis a-a. In all configurations, the pusher plate 30 can comprise a rigid material including, but not limited to, aluminum, steel and other metals and metal alloys. In particular embodiments, the pusher plate may be formed of polymers or composite materials or other materials that are more rigid and more heat resistant than the material of the sabot or separate projectile seating base. For example, the pusher plate may be formed of polyetheretherketone. Other examples include ceramic materials or filled polymers.

In operation, the disc portion 34 of the pusher plate 30 is positioned between the base 26 and the wadding 16 such that the wadding 16 pushes against the pusher plate 30 to propel the saboted projectile 14 down the barrel. In one aspect, the disc portion 34 is sized such that diameter of the disc portion 34 approximates the diameter of the base 26. Similarly, the at least one projection 36 can be sized such that the end or edge of the projection 36 is positioned proximate to or against rear of the projectile 14. The projection 36 provides axial support for the projectile seating base 26 that prevents or controls axial deformation of the projectile seating base 26 from the opposing setback and propellant forces.

Figure 19:
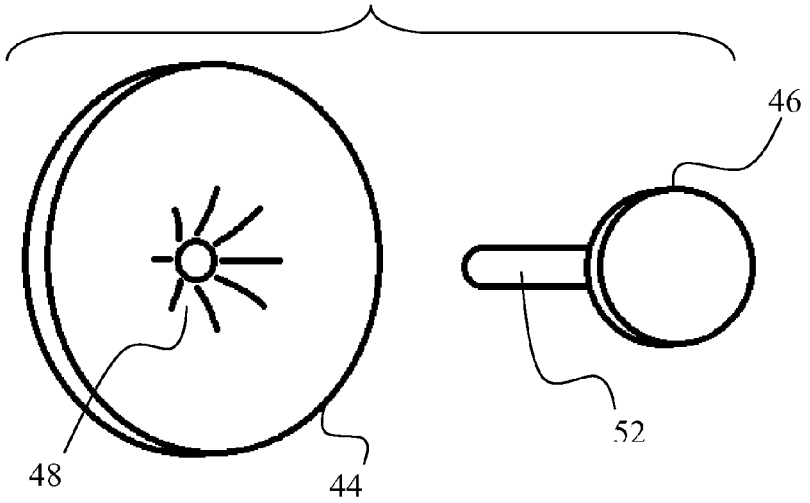
FIG. 19 is a rearward exploded perspective view of a two-piece pusher plate, according to an embodiment of the present invention.
Figure 20:
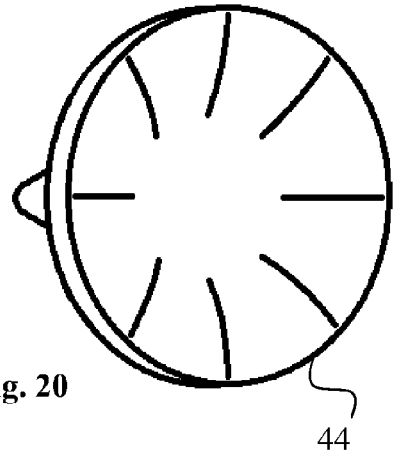
FIG. 20 is a rearward perspective view of a pusher plate, according to an embodiment of the present invention.
Figure 21:
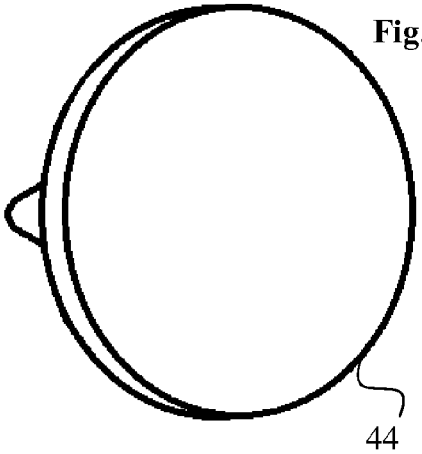
FIG. 21 is a rearward perspective view of a pusher plate, according to an embodiment of the present invention.
Figure 22:
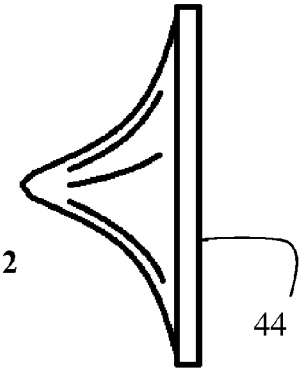
FIG. 22 is a side view of the pusher plate depicted in FIG. 21.

In one aspect, the projections 36 can be positioned to control the deformation of the projectile seating base 26 such that the seat 32 remains perpendicular to the longitudinal axis a-a as the projectile seating base 26 deforms. In this configuration, the projections 36 can be positioned proximate to the rear of the projectile 14 without engaging the rear of the projectile. In particular embodiments, the disc portion and projection are unitary and formed of metal such as aluminum. In other embodiments, a tack-like member may be inserted into a disc to form a composite pusher plate. See, for example, FIG. 19. The disc portion may be circular, that is disc shaped, and particularly where the invention is utilized with a 12 gauge cartridge, may have a thickness of 0.020 to 0.040 inches. In other embodiments, particularly where the invention is utilized with a 12 gauge cartridge, the disc portion may be 0.015 to 0.100 inches thick. In other embodiments, particularly where the invention is utilized with a 12 gauge cartridge, the disc portion may be 0.015 to 0.200 inches thick. In an embodiment, the thickness may be about 0.027 inches thick. The projection can be a post configuration, with a cylindrical rod shape having a diameter of about 0.10 inches. In other embodiments the post may have a diameter of about 0.05 to 0.15 inches. In other embodiment the post may have a diameter of about 0.05 inches to about 0.15 inches. In embodiments, the post may have a length of about 0.145 inches. In embodiments, the projection may extend about 0.10 to 0.20 from the disc portion of the pusher plate. In embodiments the length of the projection and thickness of the disc portion is about 0.162 inches. In embodiments the length of the projection and thickness of the disc portion is between 0.08 inches and 0.25 inches. In embodiments the length of the projection and thickness of the disc portion is between 0.08 inches and 0.32 inches. The post may have a flat end, a sharpened end, or a rounded end. In an embodiment where the sabot assembly is part of a 12 gauge shotgun cartridge, the diameter of the disc portion may be about 0.7 inches. In another 12 gauge embodiment, the diameter of the disc portion may be about 0.72 inches. In another 12 gauge embodiment, the diameter may be 0.50 to 0.73 inches in diameter. In a 12 gauge embodiment, the sabot may have a diameter of about 0.725 inches, or in another 12 gauge embodiment 0.70 to 0.73 inches. The projectile seating base may have an axial thickness of about 0.20 inches. In a 12 gauge embodiment the axial thickness of the projectile seating projectile seating base may be from 0.15 to 0.25 inches. In a 12 gauge embodiment the axial thickness of the projectile seating projectile seating base may be from 0.125 to 0.350 inches.

Figure 28:
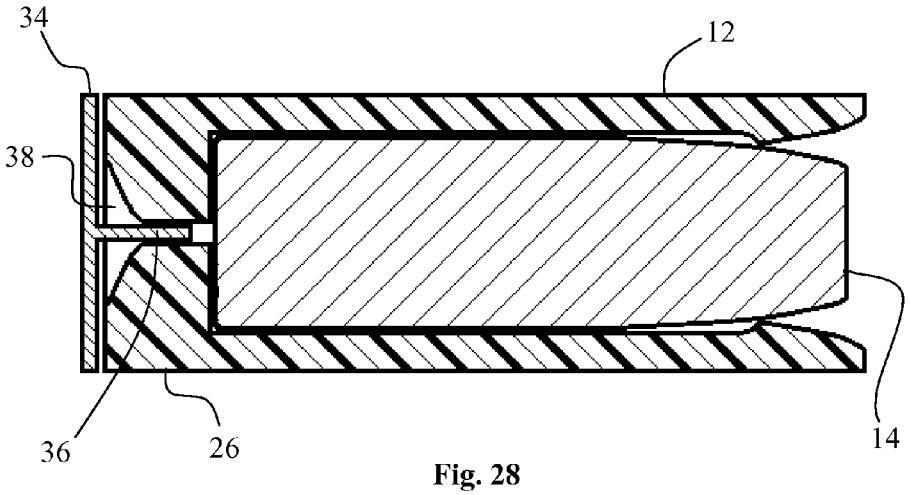
FIG. 28 is a cross-sectional side view of a cartridge having a pusher plate with a protrusion extending through a polymer base portion of a sabot and positioned for engagement of the projectile upon firing and the corresponding compression of the base portion according to an embodiment of the present invention.

In embodiments, the projection may extend into the base portion 20% or more of the axial length of the base portion. That is, the distance from the rear surface, to the forward facing projectile engaging surface. In other embodiments, the projection may be 20 to 30% of the axial length of the base portion. In other embodiments, the projection may be 30 to 60% of the axial length of the base portion. In other embodiments, the projection may be 50 to 70% of the axial length of the base portion. In other embodiments, a bore may extend entirely through the sabot base portion with the projection partially through, exactly through, or beyond the axial length of the sabot base portion. In embodiments the projection may extend 100% or more of the axial length of the base portion. In other embodiments, as illustrated in FIGS. 26-28, the projection may extend the entire thickness of the sabot base portion. In embodiments the projection may extend into a conforming recess in the slug.

In another aspect, the projection, configured as a post, 36 engages the rear of the projectile 14 to serve as a force transferring conduit that minimizes the compressive forces that are applied to the projectile seating base 26 to minimize the deformation of the projectile seating base 26. In this configuration, the force applied to the disc portion 34 can be transferred directly into the projectile 14. The post may engage a conforming recess on the projectile. This creates a stable structure extending from the pusher plate to the projectile to minimize wobble. In embodiments, the post may be positioned so that it is not engaged with the projectile before firing but after firing when the projectile seating base is compressed the post may then engage the projectile. In embodiments, a hole may be provided through the projectile seating base to the seating surface (not shown).

Figure 10:
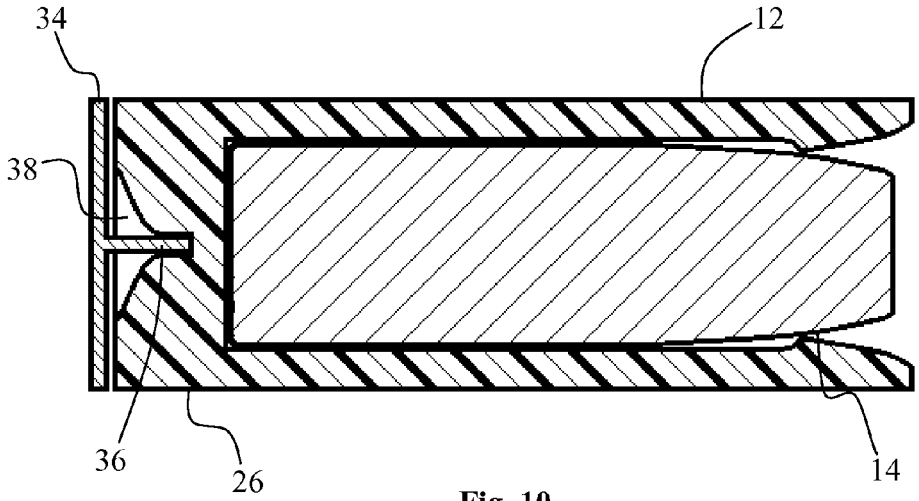
FIG. 10 is a partial cross-sectional side view of a sabot-pusher plate assembly wherein the sabot defines a generally conical opening for receiving the pusher plate according to an embodiment of the present invention.
Figure 11:
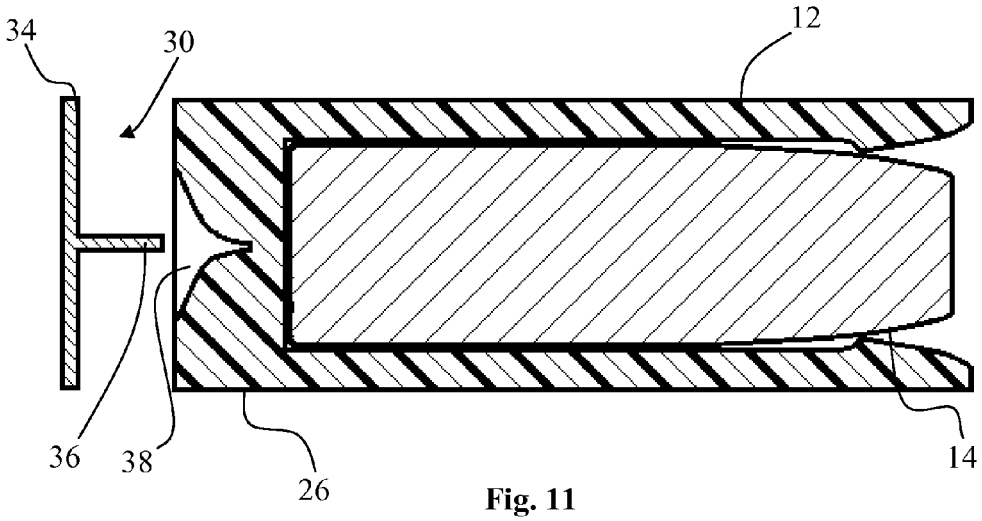
FIG. 11 is a partial exploded cross-sectional side view of a sabot-pusher plate assembly wherein the sabot defines a generally conical opening for receiving the pusher plate according to an embodiment of the present invention.
Figure 12:
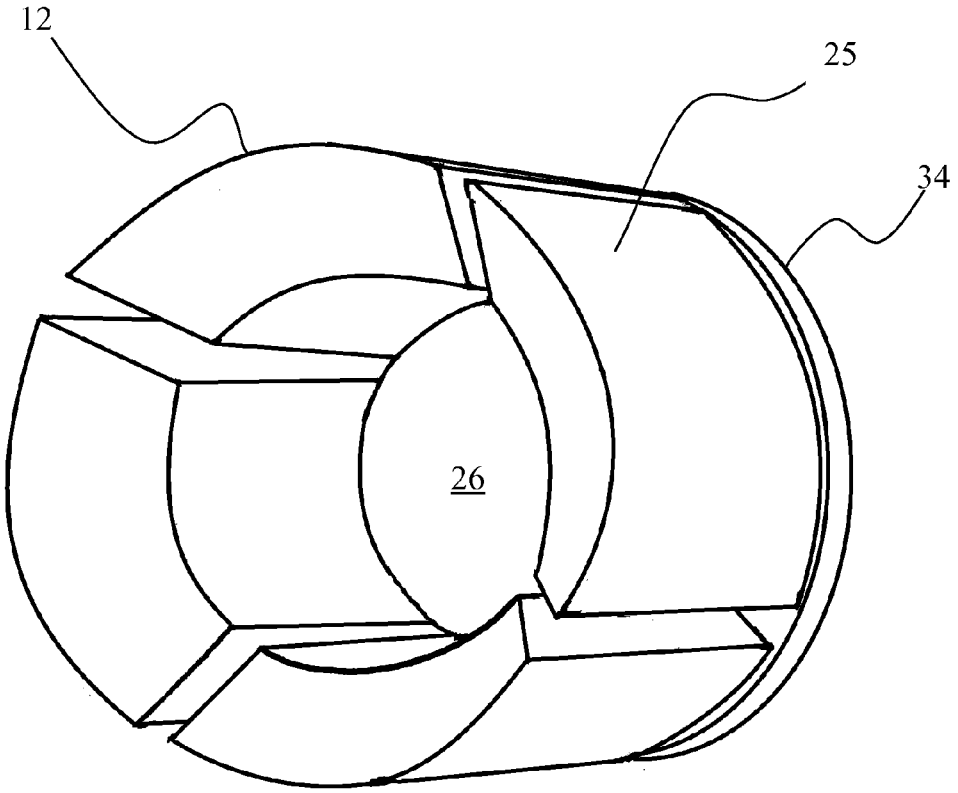
FIG. 12 is a front perspective view of a sabot-pusher plate assembly according to an embodiment of the present invention.
Figure 13:
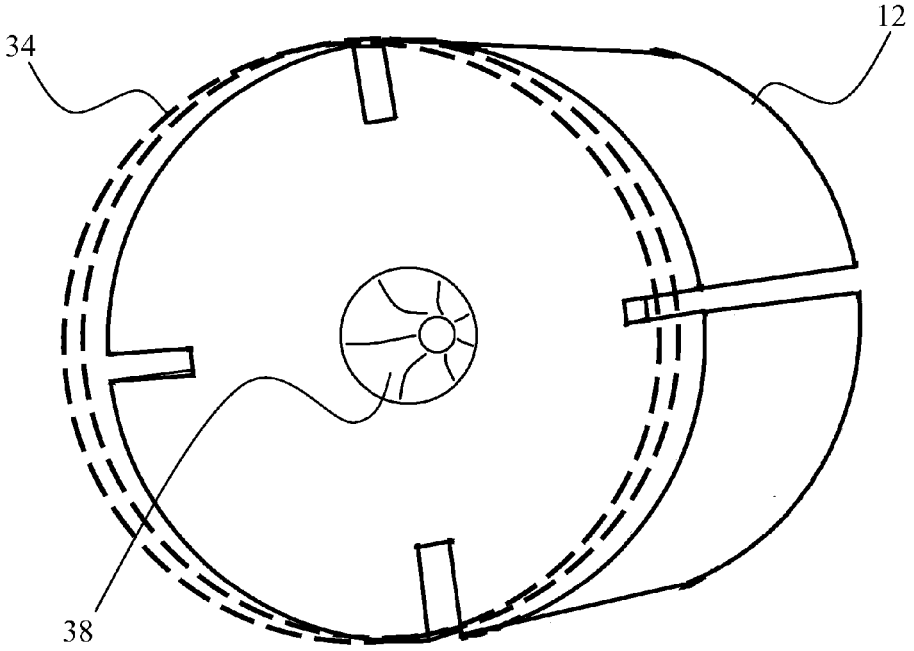
FIG. 13 is a rear perspective view of a sabot-pusher plate assembly with the pusher plate in ghost lines according to an embodiment of the present invention.

As depicted in FIGS. 10-11 and 13, the projectile seating base 26 can further comprise a recess 38 for receiving the projection 36. In one embodiment, the recess 38 can be funnel or conical or frustoconical shaped to facilitate the insertion of the projection within the bore hole 38 while aligning the pusher plate 30 with the sabot 12. Conventional sabots, due to injection molding mold design may have such a recess at the center of the rear surface of the sabot where the polymer is injected into the mold cavity. Such a recess may be utilized for receiving the projection of the pusher plate. These conventional sabots with an axially centered depression opposite the slug/projectile receiving surface, can have enhanced accuracy in shotgun shell cartridges with the placement of a rigid disc and axial projection at the sabot end. Additionally there is a dramatic improvement in non uniform axial deformation and obliteration of the sabot ends with the placement of the rigid disc at the sabot end. Ideally such is attached such as by the projection being configured as a prong or post extending from the disc into the axially centered depression.

Figure 18:
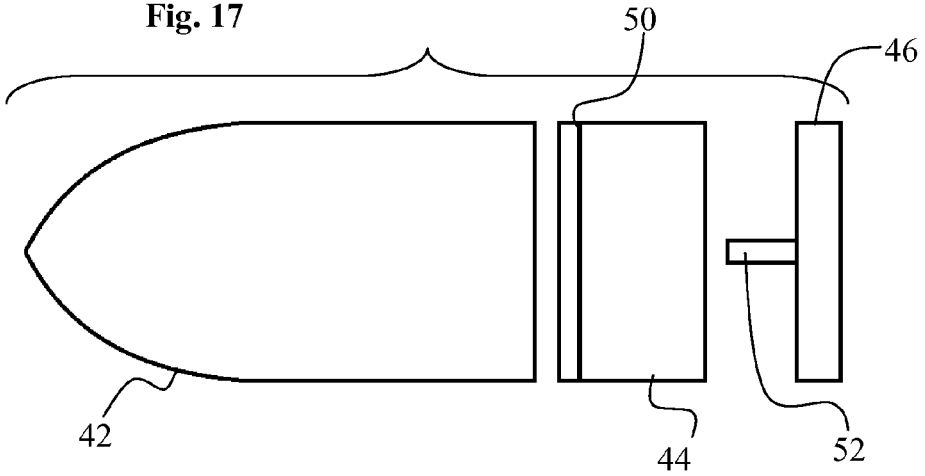
FIG. 18 is a side exploded view of the muzzleloader depicted in FIG. 14.

As depicted in FIGS. 26-28, the protrusion 36 of the pusher plate 30 can extend through the base portion 26 and engage a corresponding recess 40 in the rear of the projectile 14. The projectile recess 40 is axially centered to maintain the alignment of the pusher plate 30 as the pusher plate 30 is pushed forward during firing. In this configuration, the forward motion of the pusher plate 30 compresses the base portion 26 of the sabot 12 against the projectile 14, wherein the disc portion 34 maintains an even radial expansion of the base portion 26. In one aspect, the base portion 26 can comprise a durable polymer capable of radial deformation without fracturing. In another aspect, the base portion 26 can comprise an elastomeric material deformable by the forward motion of the pusher plate 30, as depicted in FIG. 18. In this configuration, the wings 28 can comprise a durable polymer capable of engaging the barrel walls or rifling.

A method of reducing deformation of a sabot 12 due to competing setback forces created by the inertia of a projectile 14 seated within the sabot 12 and propellant forces for propelling the saboted projectile 14, comprises positioning a pusher plate 30 against the rear of the projectile seating projectile seating base 26, wherein the pusher plate 30 comprises a projection 36 extending axially into the projectile seating projectile seating base 26 until proximate to the rear of the projectile 14. The method further comprises firing a propellant thereby directing the propellant force against the pusher 30 plate such that the energy is directed through the projection 36 into the rear of the projectile 14 rather than the through the polymer projectile seating base 26.

Figure 14:
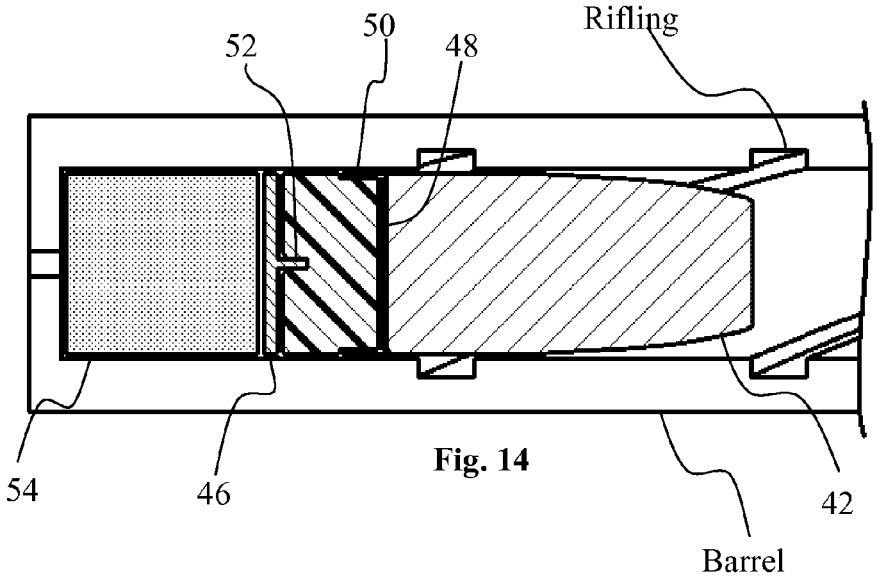
FIG. 14 is a side perspective view of a muzzleloader projectile loaded within a barrel, according to an embodiment of the present invention, prior to firing.
Figure 15:
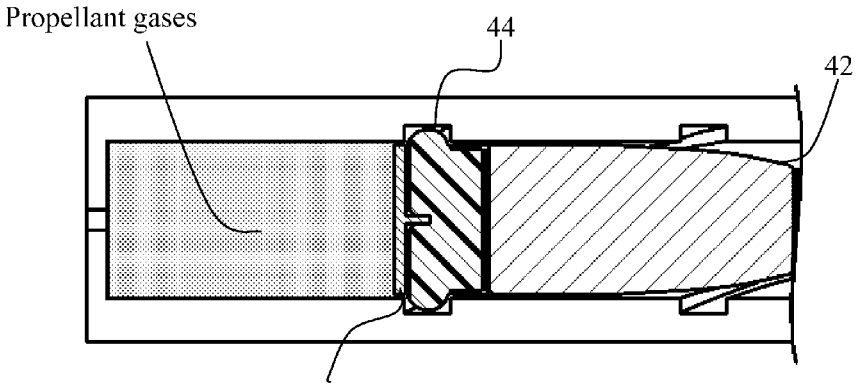
FIG. 15 is a side perspective view of the muzzleloader projectile depicted in FIG. 14 immediately after firing.

As shown in FIGS. 14-16, a muzzleloader projectile 40, according to an embodiment of the present invention, comprises a projectile body 42, a polymer base 44 and a pusher plate 46. The projectile body 42 comprises a generally conical shape and defines a longitudinal axis b-b. The projectile body 42 also defines an elongated inset cavity 48 transverse to the axis b-b and positioned at the rear of the projectile body 42. As depicted, the inset cavity 48 extends across the radial diameter of the projectile body 42. In other aspects, the inset cavity 48 can extend across less than the entire radial diameter of the projectile body 42. The polymer base 44 comprises a cylindrical shape and defines an elongated ridge 50 on one of the planar faces of the polymer base 44. The elongated ridge 50 is shaped to correspond to the shape and length of the inset cavity 48 such that the ridge 50 can be inserted into the cavity 48 to interlock the polymer base 44 with the projectile body 42. The pusher plate 46 can further comprise an axially extending projection 52 insertable into the rear of the polymer base 44 opposite the ridge 50 such that the polymer base 44 is sandwiched between the pusher plate 46 and the projectile body 42 in the assembled projectile 40.

As shown in FIGS. 14-15, a propellant charge 54 is positioned within the barrel of the muzzleloader behind the pusher plate 46 when the projectile 42 is loaded within the barrel. As depicted, the projectile 42 has an outer radius that is nominally less than the inner diameter of the lands of the rifling. In other aspects, the projectile 42 has an outer radius sized to minimally engage the rifling.

As shown in FIGS. 14-18, during firing, the propellant gases created by the ignited propellant charge 54 pushes against the pusher plate 46 to cause the polymer base 44 to expand radially outward to engage the rifling of the barrel and obturate the barrel. The projection 52 controls the radially expansion of the polymer base 44 such that polymer base 44 expands evenly outward to fully seal the projectile 40 to the barrel and maintain the alignment of axis b-b with the longitudinal axis defined by the barrel to prevent wobbling of the projectile 40. The engagement of the expanded polymer base 44 to the rifling causes the polymer base 44 to spin as the projectile 40 travels down the barrel. The interlocked ridge 50 of the polymer base 44 and cavity 48 of the projectile body 42 translates the rotation of the polymer base 44 to the projectile body 42 to spin stabilize the projectile 40. In one aspect, the ridge 50 can disengage from the inset cavity 48 upon leaving the barrel such that the spin-stabilized projectile body 42 continues onto the target.

In embodiments of the invention, a polymer obturating base with a radially extending disc and a forward axial projection that obturates upon firing in accord with an embodiment of the invention need not be directly engaged with the projectile, that is, there may be, for example, a cylindrical or ring shaped spacer there between. In that the direct compressive forces of the firing will be controlled and axially uniform, the positioning will not negate the advantages provided herein. Additionally, cylindrical base portions that provide obturation behind projectiles, that do not necessarily directly engage the projectile are included within the scope of the inventions herein. Additionally, cylindrical base portions with a disk and forward projection, whereby the disc and projection provide uniform axial deformation of the cylindrical base portion, and that do not obturate the barrel but do provide shock absorption at the firing of the propellant, and that do not directly engage the projectile are included within the scope of the inventions herein.

In embodiments of the invention the pusher plate with the disc may have a circular circumference or may have a polygonal shape. Referring to FIGS. 19-22, alternate configurations of the pusher plate are illustrated. In embodiments, the pusher plate may not be planar on each or both sides. For example, the disc may have a thickening towards the center on the forward/projectile side, resulting in a tapered shape, see FIG. 22. The rear side may have a slight central recess providing a cup shape, see FIG. 20. A tapered forward surface of the disc may extend into and define a forward axial projection, see FIG. 22. It is believed that the taper may provide an enhancement of the uniform radial outward expansion of the cylindrical polymer base into which it is inserted. This is particularly advantageous where obturation of the base portion is desired.

Figure 23:
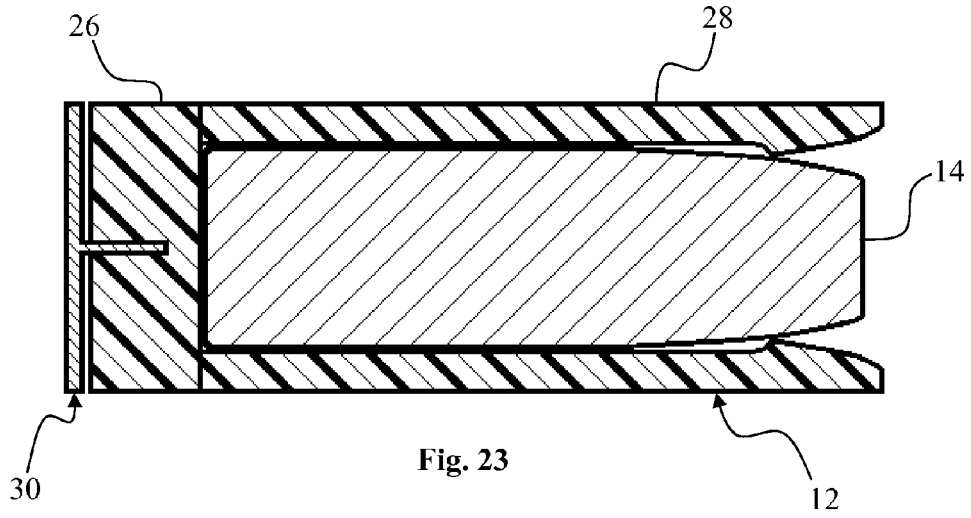
FIG. 23 is a cross-sectional side view of a cartridge having a sabot with detachable wings and a pusher plate according to an embodiment of the present invention.

Referring to FIGS. 23 to 28, various other embodiments of the base portion 26, the projection 36, and the interface between the pusher plate and base portion are illustrated. FIG. 23 illustrates that the winds of the sabot may be separate from the base portion, the base portion may be T-shaped in cross section as shown by FIG. 24. Although a gap is shown between the disk of the pusher plate and the rear surface of the base portion, they may also be in contact. FIG. 25 illustrates a T-shaped sabot base portion without a pusher plate. FIG. 26 illustrates a projection extending entirely through the base portion and into a corresponding recess 40 in the projectile 14. Upon firing the gap between the tip of the projection and the bottom of the recess may close as the base portion is compressed. FIG. 27 illustrates an elastomeric base portion with the projection extending through the base portion into a recess in the projectile. FIG. 28 illustrates an embodiment where upon firing and compression of the base portion, the projection may contact the projectile.

Various prior art references disclose materials, configurations, features, and designs suitable for incorporation with the inventive aspects and embodiments of the invention claimed herein. See U.S. Pat. Nos. 4,488,491, 4,574,703, 5,214,238 and 7,302,892. These references are herein incorporated by reference in their entirety.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A projectile assembly for conveying a projectile through a firearm barrel, the projectile assembly comprising:

a sabot, a single slug sized for the sabot, and a pusher plate, the sabot formed of a polymer and having a central longitudinal axis, a forward end, a rearward end and a generally cylindrical outer surface, the sabot comprising:

a projectile seating base with a rear surface at the rear end of the sabot and a forward projectile seating surface opposite the rear surface;

a plurality of wings unitary with and extending forwardly from the projectile seating base and positioned circumferentially around the forward projectile seating surface, the forward projectile seating surface and wings defining a cup for receiving a projectile, the wings openable outwardly for releasing the projectile after the sabot and projectile leave the firearm barrel;

the pusher plate comprising:

a disc portion positionable at the rear surface of the projectile seating base, the disc portion having a periphery;

at least one projection extending from the disc portion axially forward, the at least one projection displaced from the periphery of the disc, the disc portion abutting against the rear surface of the sabot and the projection extendable into the projectile seating base of the sabot, wherein the pusher plate is formed of a material more rigid than polymer of the sabot and is configured to not obturate the firearm barrel.

2. The projectile assembly of claim 1, wherein the disc portion of the pusher plate is circular shaped and wherein the at least one projection is a central axial projection.

3. The projectile assembly of claim 1, wherein the pusher plate is formed of metal and the disk portion is 0.015 to 0.200 inches thick.

4. The projectile assembly of claim 1, wherein the at least one projection of the pusher plate comprises a single post extending axially into the projectile seating base of the sabot along the central longitudinal axis of the sabot.

5. The projectile assembly of claim 4 wherein the pusher plate is comprised of aluminum and the disc portion and the single post are unitary.

6. The projectile assembly of claim 1, further comprising a projectile seated in the sabot and in combination with a shotgun shell cartridge, propellant and wadding.

7. The projectile assembly of claim 6, whereby when fired in a firearm, the disc portion and forwardly extending projection facilitate uniform axial deformation of the projectile seating base upon compression due to propellant ignition.

8. The projectile assembly of claim 1, wherein the size of the disc portion conforms to the rear surface of the sabot to cover substantially the entire rear surface.

9. The projectile assembly of claim 1, wherein the projectile seating base has an axial length and the projection extends into the projectile seating base a distance of at least 20% of the axial length.

10. A projectile assembly comprising:

a casing with a rearward primer end and a forward end;

a propellant in the casing adjacent the primer end;

a primer in the primer end of the casing for igniting the propellant charge;

wadding positioned adjacent the propellant;

a sabot formed of a polymer in the casing forward of the wadding, the sabot comprising a deformable cylindrical portion unitary with a plurality of forwardly extending wings, the sabot having a rear end with a rear surface, and a central longitudinal axis, a pusher plate comprising a non-obturating rigid disc and a central projection extending from the disc forwardly into the deformable cylindrical portion at the rear end of the sabot, the pusher plate formed of a material more rigid than the polymer of the sabot, a portion of the pusher plate engaging the sabot; and a projectile positioned in the sabot seated on the projectile seating base.

11. The projectile assembly of claim 10, wherein the rear surface of the sabot has a tapered recess and wherein the rigid disc is engaged with the rear surface of the sabot and the central projection extends into the tapered recess.

12. The projectile assembly of claim 11 wherein rigid disc has a circular periphery and the projection is rod shaped and unitary with the rigid disc.

13. The projectile assembly of claim 10, wherein the sabot has a forward facing projectile seating surface, and there is an axial length between the forward facing projectile seating surface and the rear surface of the sabot, and wherein the projection extends into the sabot a distance of at least 20% of said axial length.

14. The projectile assembly of claim 10, wherein the sabot is formed of polyethylene and the pusher plate is formed of aluminum.

15. A projectile assembly for conveying a projectile through a firearm barrel, the projectile assembly comprising:

a sabot having a deformable cylindrical polymer base portion positioned rearwardly of the projectile, the cylindrical polymer base portion having a forward end for facing the projectile, a rearward end for facing toward propellant, a central axis and a length;

a pusher plate in engagement with the rearward end of the cylindrical polymer base portion, the pusher plate having a disc portion with a periphery and a forwardly extending projection with a tip end extending from the disc portion along the central axis of the cylindrical polymer base portion into the cylindrical polymer base, the pusher plate formed of a material more rigid than the cylindrical polymer base portion whereby upon firing a propellent rearwardly of the projectile assembly in the firearm barrel, the cylindrical polymer base portion is compressed axially and deforms, and the pusher plate and forwardly extending projection facilitate uniform axial deformation of the cylindrical polymer base portion upon the compression due to the propellant ignition.

16. The projectile assembly of claim 15 wherein the pusher plate further comprises a projection extending axially therefrom and wherein the projection is positioned in an axially extending preformed recess at the rear end of the cylindrical polymer base portion.

17. The projectile assembly of claim 15 wherein the cylindrical polymer base portion is sized such that the deformation of the cylindrical polymer base portion provides obturation of the firearm barrel as the cylindrical polymer base portion and projectile travel down the barrel.

18. The projectile assembly of claim 15 wherein the pusher plate is T-shaped in a cross section taken in an axial plane.

19. The projectile assembly of claim 15, wherein the sabot is formed of a polyethylene and the pusher plate is formed of aluminum.

20. The projectile assembly of claim 15, wherein the sabot has a forward facing projectile seating surface, and there is an axial length between the forward facing projectile seating surface and the rear surface of the cylindrical polymer base portion, and wherein the projection extends into the cylindrical polymer base portion a distance of at least 20% of said axial length.

* * * * *